United States Patent [19]

Martin

[11] 4,097,111

[45] Jun. 27, 1978

[54] ELECTRICAL CONNECTOR

[75] Inventor: Roger A. Martin, Swampscott, Mass.

[73] Assignee: The Murdock Corporation, Chelsea, Mass.

[21] Appl. No.: 691,565

[22] Filed: Jun. 1, 1976

[51] Int. Cl.[2] ..... H01R 17/18

[52] U.S. Cl. ..... 339/183; 179/1 PC; 339/DIG. 3

[58] Field of Search ..... 339/183, 18, DIG. 3, 339/182; 179/1 PC

[56] References Cited

U.S. PATENT DOCUMENTS

| | | | |
|---|---|---|---|
| 664,557 | 12/1900 | Jones | 339/18 C |
| 1,087,044 | 2/1914 | Naylor | 339/183 |
| 1,950,215 | 3/1934 | Baum | 339/183 |
| 2,107,416 | 2/1938 | Huth | 179/1 PC |
| 2,911,614 | 11/1959 | Davis | 339/182 R |
| 3,145,329 | 8/1964 | Deakin et al. | 339/183 |
| 3,175,179 | 3/1965 | Trump | 339/18 C |
| 3,871,737 | 3/1975 | Dorrell et al. | 339/DIG. 3 |
| 3,880,486 | 4/1975 | Avakian | 339/DIG. 3 |

FOREIGN PATENT DOCUMENTS

| | | | |
|---|---|---|---|
| 587,750 | 1/1959 | Italy | 339/182 R |

OTHER PUBLICATIONS

IBM Tech. Disc. Bulletin, vol. 13, No. 6, Nov. 1970, p. 1625, Rice.

*Primary Examiner*—Neil Abrams
*Attorney, Agent, or Firm*—Joseph Zallen

[57] ABSTRACT

An electrical connector adapted to engage a plug and formed from an insulating frame with two open ends and a resilient, conductive plastic member across each end. The resilient conductive members have orifices in which the plugs are inserted and gripping finger portions adapted to press against the exposed conductive portions of the plug.

2 Claims, 5 Drawing Figures

ELECTRICAL CONNECTOR

BACKGROUND OF INVENTION

This invention relates to electrical connectors. In particular it relates to electrical connectors for low current devices.

Low current electrical systems are widely used, including, for example, audio equipment, communication devices, alarm systems and vehicle and marine lighting systems.

It is common to make electrical connections in such low current systems by means of plugs and sockets. Plugs and sockets provide ease in attaching and detaching connections from various components.

However, plug and socket combinations that are in common use suffer from one or more deficiencies. In particular, the sockets require many steps to assemble and have a large number of individual elements. Some sockets, for example, require 36 elements. Another disadvantage is that sockets as conventionally made often become distorted or corroded with age and thus tend to bind the plug with the result that plugs are frequently broken.

One object of the present invention is to provide an inexpensive socket for use with conventional plugs.

Another object of the present invention is to provide such a socket made from a small number of parts.

A further object of this invention is to provide such a socket which is readily and safely manipulable by children without breakage.

Still another object of this invention is to provide such a socket with a longer life than conventional sockets.

And yet a further object of this invention is to provide such a socket which is sufficiently corrosion resistant to be used in moist atmospheres such as in high humidity or at sea.

Other objects and advantages of this invention will be apparent from the discription and claims which follow taken together with the appended drawings.

SUMMARY OF INVENTION

This invention comprises generally a socket formed by a rigid insulating frame having open ends across which are mounted resilient, conductive plastic members. The plug is pushed through an orifice in one conductive plastic member into a registering orifice of the frame member. The conductive member has portions in the nature of fingers or leaves adapted to press against the body of the plug and thus form a conductive path from the outer metal sheet of the plug to the conductive plastic. The conductive tip of the plug extends through the insulating frame and terminates against fingers or leaves of the second resilient, conductive plastic member.

The components of this invention are preferably easily separated from one another. Thus, each conductive member can be readily removed or attached by flexing. The components are three in number, namely the insulating frame member and the upper and lower resilient conductive plastic members. However, the invention can take many forms and a preferred form of this invention is described hereinafter in detail. In one form of this invention, the socket can be mounted in a device, as for example, a radio or tape recorder where the inner conductive plastic member is permanently connected to some part of the circuit while the outer conductive member permits a plug attachment to an external device.

A preferred form of this invention comprises a multiple socket device containing a plurality of sockets so that the invention can act as a central switching arrangement. Such an arrangement is particularly suitable in a classroom where an audio program is intended to be heard through multiple pairs of earphones which can be easily connected to the multiple socket device. Such multiple socket devices as made in accordance with this invention are characterized as having the same three components, namely a central insulating and separating frame covered on each end with a resilient, conductive plastic member having orifices, each of which is provided with engaging fingers.

Little effort is required to engage or disengage a plug from a socket made in accordance with this invention. Further, all the components of the device are sturdy and thus resist breakage. The resilient conductive plastic fingers provide good contact. Further, plugs of various sizes and dimensions can be accomodated by minor dimensional changes, as for example, in the height or in the orifice size of the rigid insulator frame or in the orifice size of the conductive plastic member. Where the conductive plastic members fit tightly over the ends of a cylindrical insulating frame member, the electrical connection is isolated from the atmosphere and particularly from water, spray or the like.

A resilient conductive material which can be used in this invention is a conductive vinyl compound having a relatively low resistance. An example of such a compound is ABBEY 100, manufactured by Abbey Plastic Corporation of Hudson, Massachusetts in accordance with U.S. Pat. No. 3,111,495 and characterized as having the following properties:

| | |
|---|---|
| 1. Resistivity (ohm-cm$^3$) | 6 |
| 2. Tensile Strength (psi) | 1500 |
| 3. Modulus at 100% Elongation (psi) | 1450 |
| 4. Elongation (per cent) | 125 |
| 5. Durometer (Shore A) | 88 |
| 6. Specific Gravity | 1.39 |

SPECIFIC EXAMPLE OF INVENTION

Figure 1:
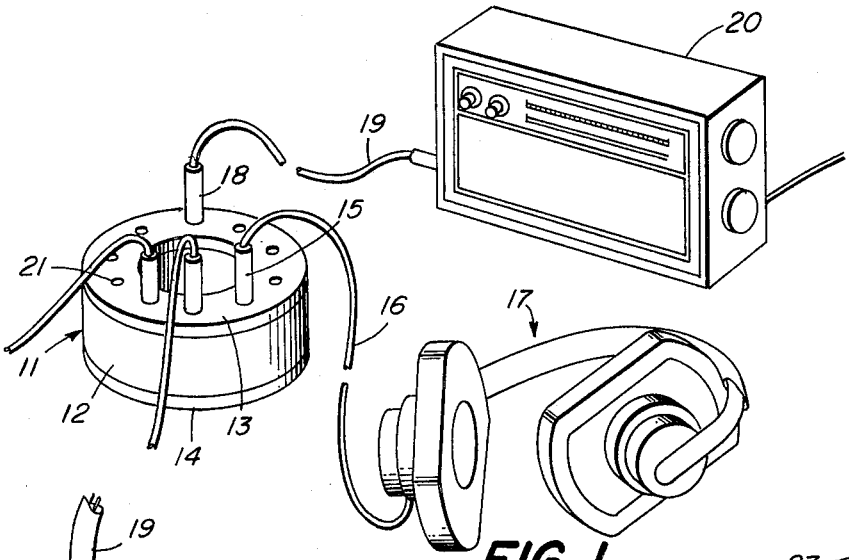
FIG. 1 is a perspective view of one embodiment of this invention showing the distribution of an audio signal to individual head sets.

Referring now to the drawings, there is illustrated therein an example of this invention utilized as a distributing station for an audio program. A radio or other audio device 20 is detachably connected by cable 19 and plug 18 to the distributing station 11. A plurality of head sets 17 are detachably connected through cable 16 and plug 15 to the distributing station and are thus fed the signal coming in from audio device 20.

Figure 5:
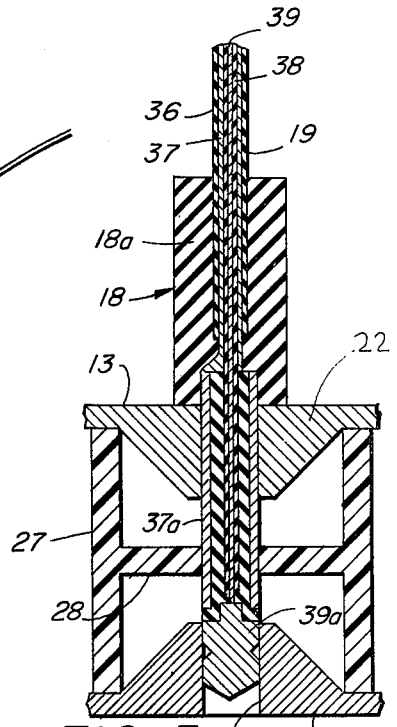
FIG. 5 is a cross sectional view of a section of FIG. 2.
Figure 2:
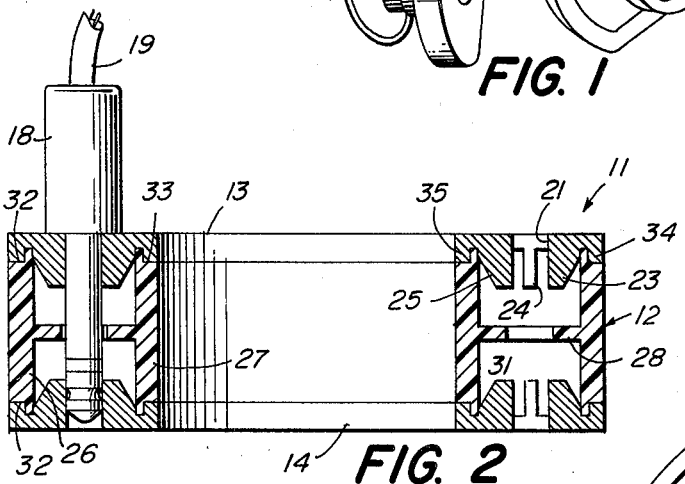
FIG. 2 is a partial section of a portion of FIG. 1.
Figure 3:
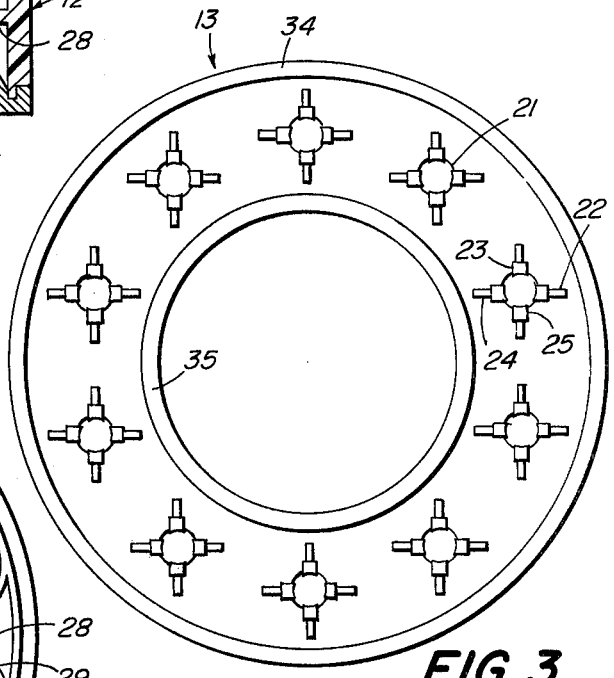
FIG. 3 is a bottom view of conductive, resilient plastic member 13.
Figure 4:
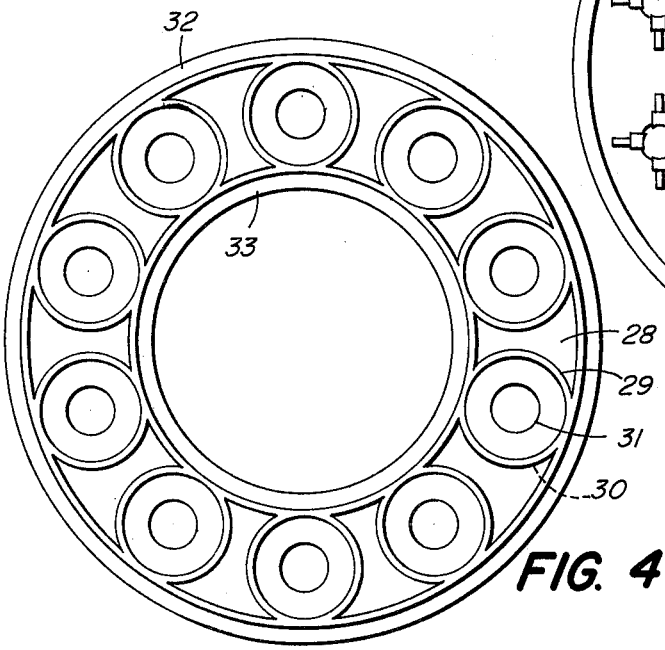
FIG. 4 is a top view of rigid insulating frame member 32.

Distributing station 11 comprises rigid insulating frame 12 having open ends across which are detachably mounted resilient, conductive members 13 and 14. Conductive members 13 and 14 have orifices 21 through which a plug such as 18 or 15 has its conductive portions making appropriate conductive contact with conductive members 13 and 14 as more particularly illustrated in FIGS. 2 and 5. Orifice 21 is characterized as being surrounded by finger portions 22, 23, 24, and 25 of the conductive member which by their resilient grip insure conductive contact between the outer metal shell 37*a* and the upper conductive member 13 on the one hand, and the lower conductive tip 39*a* with the lower conductive member 14. As shown in FIG. 5, shell 37*a* is conductively connected to the outer conductor 39 of the cable 19 while tip 39*a* is conductively connected to the inner wire 39 of cable 19. Cable 19 has conventional insulation 36 and 38 for its two conductors and insulating holding portion 18*a*.

The open insulating frame 12 has top and bottom indentations 32, 33, 34 and 35 to accomodate registering portions of the conductive members 12 and 14 so as to provide a tight and firm attachment. The insulation frame 12 as herein illustrated also has separated tubular portions 27 and 30 on either side of a central, horizontal wall 28. The insulating frame 12 is annular having an outer wall 32 and an inner wall 33. A plug is thus firmly held by the resilient fingers 22 through 25 of upper resilient conductive plastic 22, orifice 31 in frame 12 and the resilient fingers 22 through 25 of the lower resilient conductive plastic 14.

I claim:

1. A distributing station for an audio device whereby the signal coming from the audio device (20) can be fed to a plurality of listening devices, such as head sets, (17) by detachably connecting plugs (15) to said distributing station, comprising:

(a) a rigid, one piece, integral insulating frame (12) formed with side walls (26, 27) defining open top and bottom portions, a web (28) extending transversely of and connecting said side walls intermediate said top and bottom portions, and a plurality of plug guide apertures (31) in said web each surrounded by a receptacle defining wall (29) formed on the bottom and top surfaces of said web and extending from said top to said bottom portions;

(b) two identical, resilient conductive plastic members (13, 14) free of metal and mounted across said open portions and having a plurality of orifices (21) aligned with said apertures, each of said members having integral, resilient gripping fingers (23) aligned with each of said orifices, and each of said members being supported upon said side walls and said receptacle defining walls;

(c) whereby, when a plug is inserted in an aligned set of apertures and orifices, the plug is conductively gripped by said resilient fingers to form an electrical connection therewith.

2. The distributing station of claim 1 wherein said rigid insulating frame (12) has top and bottom indentations (32) and said conductive members (13) have registering portions whereby said conductive members are readily attachable or detachable on said insulating frame.

* * * * *